US007248026B2

(12) United States Patent
Ritter

(10) Patent No.: US 7,248,026 B2
(45) Date of Patent: Jul. 24, 2007

(54) SINGLE-PIN TRACKING/SOFT-START FUNCTION WITH TIMER CONTROL

(75) Inventor: David Wayne Ritter, San Jose, CA (US)

(73) Assignee: Micrel, Incorporated, San Jose, CA (US)

( * ) Notice: Subject to any disclaimer, the term of this patent is extended or adjusted under 35 U.S.C. 154(b) by 0 days.

(21) Appl. No.: 11/288,884

(22) Filed: Nov. 28, 2005

(65) Prior Publication Data

US 2007/0120544 A1 May 31, 2007

(51) Int. Cl.
*G05F 1/46* (2006.01)
*G05F 1/575* (2006.01)

(52) U.S. Cl. ..... 323/281; 323/274; 323/275

(58) Field of Classification Search ..... 323/273–276, 323/279, 280, 281, 901; 363/49
See application file for complete search history.

(56) References Cited

U.S. PATENT DOCUMENTS 4,716,510 A * 12/1987 Pace et al. ..... 363/49
6,091,234 A * 7/2000 Kitagawa ..... 323/244
6,147,477 A * 11/2000 Saeki et al. ..... 323/273
6,313,615 B1 * 11/2001 Fayneh et al. ..... 323/281
6,356,061 B1 * 3/2002 Perillo ..... 323/274
7,038,412 B2 * 5/2006 Karwath et al. ..... 318/434
2005/0007167 A1 * 1/2005 Tange ..... 327/172

* cited by examiner

*Primary Examiner*—Gary L Laxton
(74) *Attorney, Agent, or Firm*—Bever, Hoffman & Harms, LLP; Patrick T. Bever

(57) ABSTRACT

A voltage regulator includes a voltage divider connected between a soft-start pin and the voltage regulator's error amplifier. The voltage divider has the same divider ratio as that of the voltage regulator's feedback voltage divider, which is used to divide the regulated output voltage fed back to the error amplifier. To facilitate soft-start operations, an external, user-supplied capacitor is connected to the soft-start pin. To facilitate voltage tracking operations, a predetermined master supply voltage is applied to the soft-start pin.

9 Claims, 2 Drawing Sheets

SINGLE-PIN TRACKING/SOFT-START FUNCTION WITH TIMER CONTROL

FIELD OF THE INVENTION

This invention relates to voltage regulators and, more particularly, to voltage regulators providing soft start and tracking functions.

BACKGROUND OF THE INVENTION

Voltage regulators are well known in the art. These devices attempt to provide a stable, nearly constant (regulated) supply voltage to a load. Further, these devices attempt to maintain the supply voltage at the nearly constant value regardless of the current demands of the load. In one practical application, voltage regulators are utilized in complex electronic systems to convert an unregulated supply voltage (e.g., from a battery) into a regulated supply voltage of a predetermined value that is supplied to one or more discrete components of the complex electronic systems.

Complex electronic systems incorporating components such as microprocessors, field programmable gate arrays (FPGAs), and digital application specific integrated circuits (ASICS) often require voltage regulators that provide soft start, voltage tracking, and/or timing delay control of the supplied system voltage. Each of these functions, which are described in additional detail in the following paragraphs, serves to prevent faulty operation and/or damage to the components of the complex electronic system.

The soft-start and soft-stop functions control system voltages at startup and shutdown such that supply voltages rises at a known controlled rate at startup, stop reliably at the programmed operating voltage without overshoot, and then decrease at a controlled rate at shutdown. The soft-start function is particularly used to control inrush currents in capacitors, minimize load surges in battery sources, or to moderate the effect of voltage spikes. The soft-start function typically utilizes a user-supplied external capacitor that is mounted to a dedicated external pin of the voltage regulator. A small current applied to this soft-start capacitor during the startup process causes the charge stored in the capacitor to gradually increase, and this gradually increasing charge is utilized to produce the ramped voltage signal. During soft-stop operations, the current applied to the soft-start capacitor is reversed, and the voltage ramps down as the soft start capacitor discharges.

The voltage tracking function controls system voltages during operation such that they remain equal to or less than a predetermined master supply voltage. The predetermined master supply voltage is typically transmitted to the voltage regulator by way of another external pin (i.e., different from the external pin used to implement the soft start function).

The delay control function regulates system operations by generating a "POWER GOOD" signal at start up that asserts a TRUE value after a programmable delay once predetermined output conditions are met. On shutdown, the delay function maintains an active output power for a programmable delay time after an ENABLE input signal has been removed from an external control source. Similar to the soft start function, the programmable delay is generated using an external user-supplied capacitor that is connected to a dedicated pin.

Conventional systems providing soft start, voltage tracking, and delay control functions are controlled using control signals applied to three separate external pins. Because the number of external pins is limited by the selected package type, it is desirable to minimize the number of external pins needed to perform start up and voltage control functions.

What is needed is a method and structure for controlling both soft-start and voltage control functions in a complex electronic system using a single external pin. In addition, what is needed is a method and structure for allowing a customer complete control of both startup and shutdown supply sequences using a minimum number of external pins.

SUMMARY OF THE INVENTION

The present invention is directed to a structure for controlling both tracking and soft-start functions in a voltage regulator using a single external soft-start/tracking pin by providing a soft-start/tracking voltage divider between the soft-start/tracking pin and the voltage regulator's error amplifier. By constructing the soft-start/tracking voltage divider such that it has the same divider ratio as that of the voltage regulator's feedback voltage divider, which is used to divide the regulated output voltage fed back to the error amplifier, the soft-start/tracking pin can be utilized to perform both soft-start and tracking functions, thereby eliminating the need for two pins to perform these functions, which is required in conventional arrangements.

In accordance with an embodiment of the present invention, a timer controller is utilized to delay the execution of a soft stop function until a predetermined delay period has expired, thereby allowing a customer complete control of both startup and shutdown supply sequences using a minimum number of external pins.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The terms "coupled", "connected", "substantially equal", which are utilized herein, are defined as follows. The term "connected" is used to describe a direct connection between two circuit elements, for example, by way of a metal line formed in accordance with normal integrated circuit fabrication techniques. In contrast, the term "coupled" is used to describe either a direct connection or an indirect connection between two circuit elements. For example, two coupled elements may be directly connected by way of a metal line, or indirectly connected by way of an intervening circuit element (e.g., a capacitor, resistor, inductor, or transistor). The term "substantially equal" is defined herein as two measurable values being within a range of ten percent.

Figure 1:
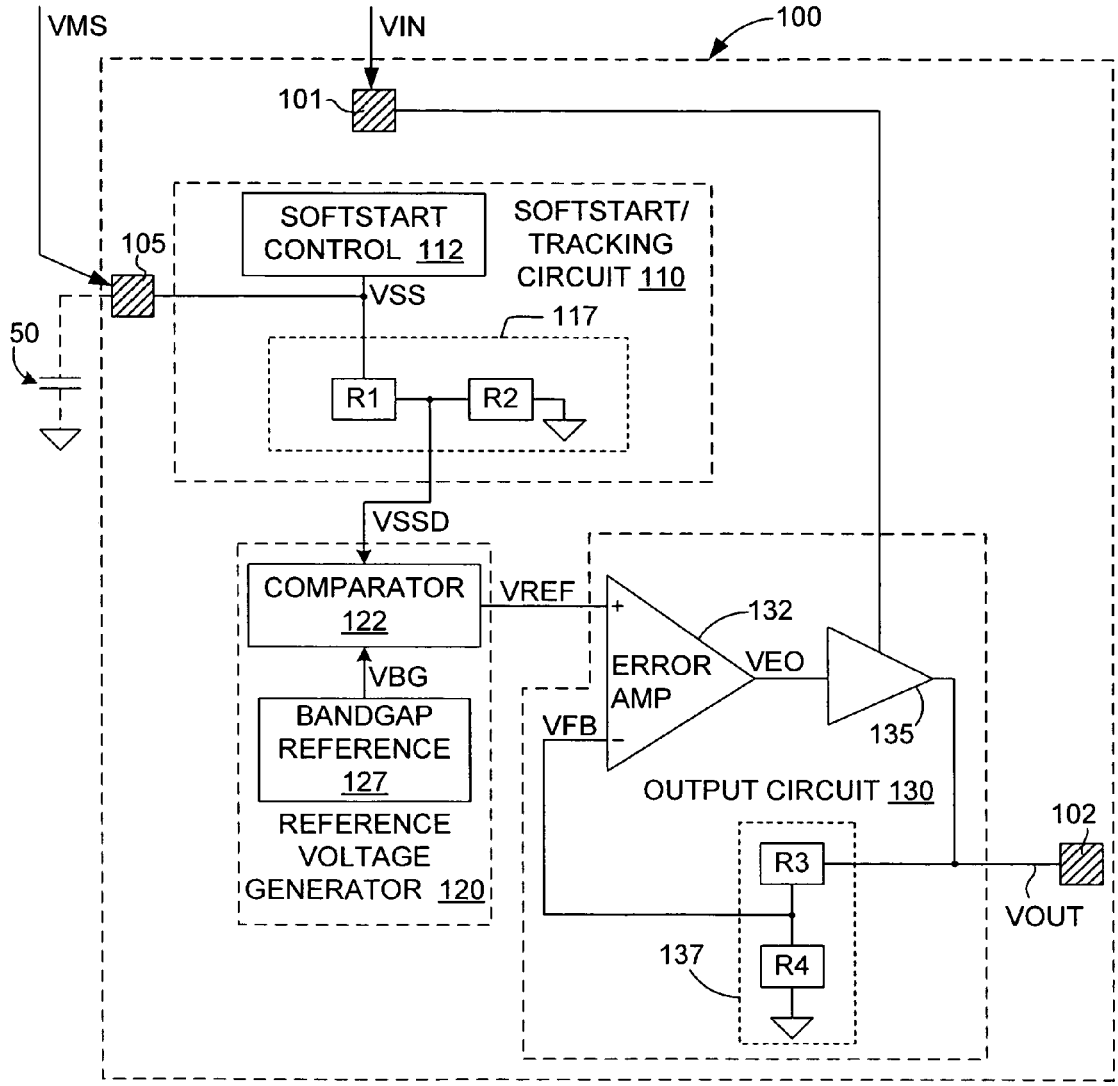
FIG. 1 is a block diagram showing a voltage regulator according to a simplified embodiment of the present invention.

FIG. 1 shows a voltage regulator 100 according to a simplified embodiment of the present invention. In one embodiment voltage regulator 100 is a discrete device (i.e., fabricated and packaged separately from other components of a complex electronic system circuit to which voltage regulator 100 is connected). As such, voltage regulator 100 includes several external pins for facilitating the transmission of power and control signals to and from the host complex electronic system circuit. These external pins include an input pin 101 for receiving an unregulated system voltage VIN, an output pin 102 for facilitating the transmission of a regulated output signal VOUT to an external circuit (not shown), and a soft-start/tracking pin 105. Other external pins of voltage regulator 100 are omitted from the following discussion for brevity. In an alternative embodiment, voltage regulator 100 may be part of a larger integrated circuit, in which case output pin 102 is implemented by an interconnect (metal) line that may not be accessed externally Voltage regulator 100 generally includes a combined soft-start/tracking circuit 110, a reference voltage generator 120, and an output circuit 130. Soft-start/tracking circuit 110 includes a soft-start control circuit 112 having an output terminal connected to soft-start/tracking pin 105 and to a first terminal of soft-start/tracking voltage divider 115. Soft-start/tracking voltage divider 117 includes a first resistor R1 and a second resistor R2 connected in series between the first terminal and ground. A second terminal of soft-start/tracking voltage divider 115, which is connected between resistors R1 and R2, is connected to an input terminal of reference voltage generator 120. Reference voltage generator 120 includes a unity gain comparator (min amp) circuit 122 and a bandgap reference generator 127, and generates a reference signal VREF that is transmitted to output circuit 130. Output circuit 130 includes an error amplifier (ERROR AMP) 132, an output driver circuit 135, and a feedback voltage divider 137. Error amplifier 135 has a first input terminal that receives reference signal VREF and a second input terminal that receives a feedback signal VFB from feedback voltage divider 137. Output driver circuit 135 generates a desired regulated output voltage VOUT in response to an error output signal VEO generated by error amplifier 135. The regulated output voltage VOUT is transmitted to output pin 102, which is also connected to feedback divider 137. Feedback voltage divider 137 includes a third resistor R3 and a fourth resistor R4 connected in series between output pin 102 and ground, and feedback signal VFB is generated at a node located between resistors R3 and R4.

At startup and shutdown (i.e., when unregulated input voltage VIN is applied to/disconnected from input pin 101), soft-start control circuit 112 facilitates soft-start and softstop functions by asserting/deasserting a current signal on soft-start/tracking pin 105. At startup, soft-start control circuit 112 supplies a small, known current to soft-start/tracking pin 105 according to known techniques. When regulator device 100 is enabled, the current supplied by soft-start control circuit 112 will cause system voltage VSS to rise linearly on the soft-start/tracking pin 105. The rate of rise is determined by the capacitance of a user-supplied external capacitor 50 and the current supplied by soft-start control circuit 112. System voltage VSS is applied to soft-start/tracking voltage divider 117, which passes a fractional voltage VSSD of system voltage VSS, which is equal to system voltage VSS multiplied by (R2/(R1+R2)). Fractional voltage VSSD is supplied to one input of comparator circuit 122. Comparator circuit 222 compares fractional voltage VSSD and bandgap signal VBG, which is generated by bandgap reference circuit 127 according to known techniques, and provides the smaller of these voltages as reference voltage VREF. For example, when a (first) voltage level of fractional voltage VSSD is less than a (second) voltage level of bandgap signal VBG, then reference signal VREF is equal to fractional voltage VSSD. Conversely, when fractional voltage VSSD is greater than bandgap signal VBG, reference signal VREF is equal to bandgap signal VBG. The function of comparator circuit 122 is to cause the input to error amplifier 132 to be controlled by the voltage on soft-start/tracking pin 105 as long as fractional voltage VSSD is less than the voltage level of bandgap signal VBG. At startup, system voltage VSS and fractional voltage VSSD will be zero, causing reference voltage VREF to also be zero. As external capacitor 50 charges, system voltage VSS and fractional voltage VSSD will rise, thereby causing a corresponding rise in reference voltage VREF. Reference voltage VREF will continue to rise until fractional voltage VSSD reaches the voltage level of bandgap voltage VBG, at which point reference voltage VREF will stabilize at the voltage level of bandgap voltage VBG. Accordingly, the effective reference voltage VREF of regulator 200 will rise smoothly from zero to VBG, thereby performing the desired soft-start function. At shutdown (i.e., when device 200 is disabled), the current at soft-start/tracking pin 105 may be reversed through soft-start control circuit 112 to effectively discharge external capacitor 50 in a ramped fashion, thereby facilitating a softstop function using the same circuitry as that used to perform the soft-start operation.

During normal operation without tracking control (i.e., after VREF has ramped up to VBG and before shutdown), as in a conventional regulator, the regulated output voltage VOUT generated at output pin 102 is determined by reference voltage VREF supplied to error amplifier 132, and feedback voltage VFB supplied by voltage divider 137. In particular, output voltage VOUT is VREF multiplied by the value (1+R3/R4), or VREF*(R3+R4)/R4. Assuming the gain of error amplifier 132 is high, during normal operation reference voltage VREF is substantially equal to feedback voltage VFB.

In accordance with the present invention, a voltage tracking control function is integrated with the soft-start function by including soft-start/tracking voltage divider 117 between soft-start control circuit 112 and reference voltage generator 120, and in particular by forming tracking voltage regulator 117 such that it has an effective voltage divider ratio (i.e., R1/R2) that is substantially equal to the voltage divider ratio of feedback voltage divider 137 (i.e., R3/R4). The tracking control function is implemented by transmitting a predetermined master supply voltage VMS to soft-start/tracking pin 105 from an external source (not shown). Because the effective divider ratios of voltage dividers 117 and 137 are substantially equal, output voltage VOUT equals the predetermined master supply voltage VMS as long as fractional voltage VSSD is less than bandgap voltage VBG, and output voltage VOUT equals bandgap voltage VBG times (1+(R3/R4)) at all other times, thus implementing the desired tracking function. The first divider ratio (R1/R2) may be set slightly higher than the second divider ratio (R3/R4) so that the output voltage VOUT tracks slightly above the master supply voltage VMS. This small amount does not affect external circuitry, but is included for the particular case where, for example, a 1.8V slave unit is tracking a 1.8V master unit. Alternatively, if soft-start/tracking pin 105 is connected to an external capacitor, a soft-start feature is realized as described above. Accordingly, both soft-start and tracking functions are implemented using a single external pin (i.e., soft-start/tracking pin 105), thereby eliminating the need for a separate external pins to control the soft-start and voltage tracking functions.

Figure 2:
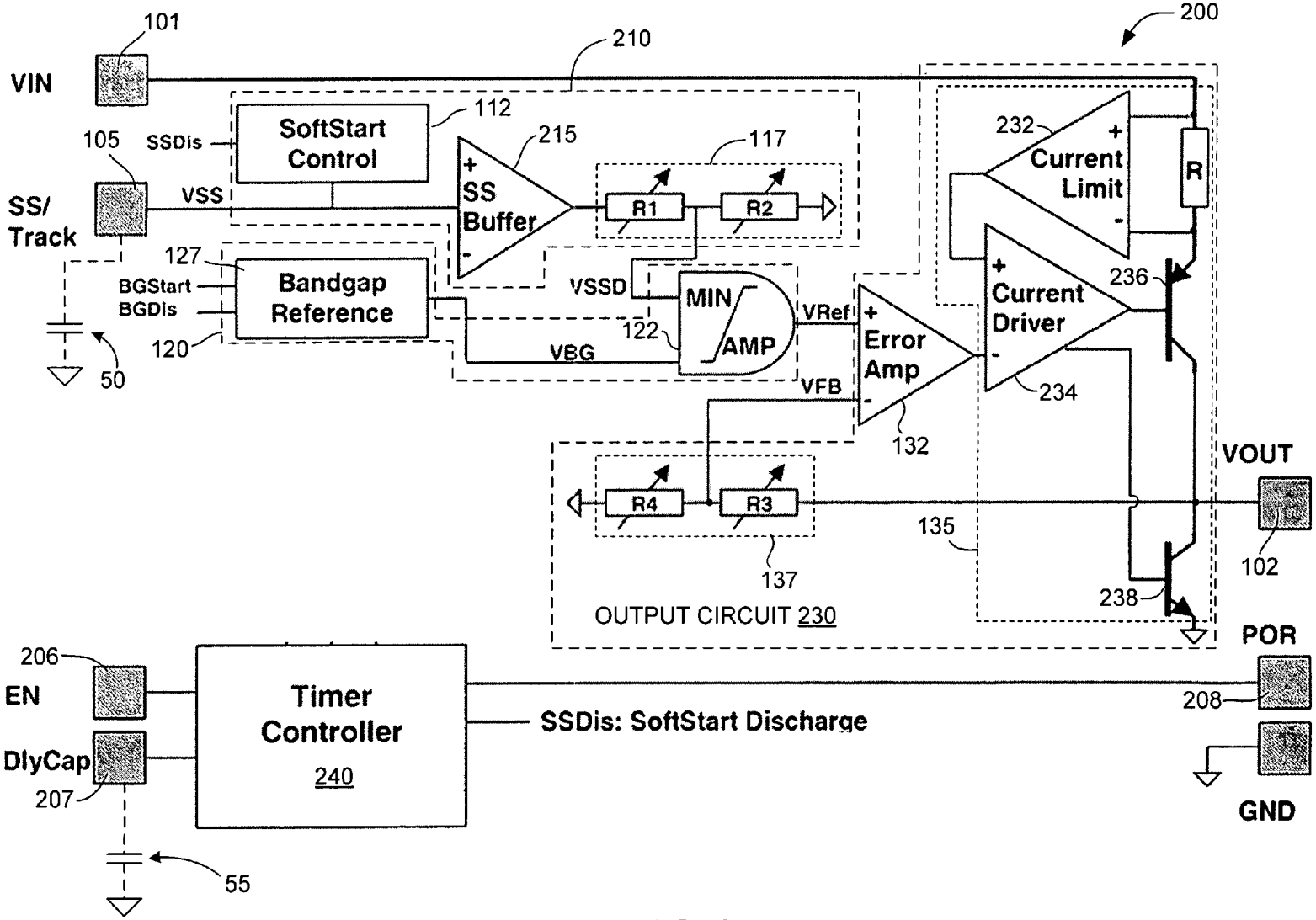
FIG. 2 is a block diagram showing a voltage regulator according to another embodiment of the present invention.

FIG. 2 is a block diagram showing a voltage regulator 200 according to another embodiment of the present invention. Elements of voltage regulator 200 that perform functions similar to associated elements of voltage regulator 100

(described above) are identified with the same reference numbers, and detailed description of these elements is omitted for brevity.

Referring to the upper portion of FIG. 2, in addition to soft-start control circuit 112 and voltage divider 117, soft-start/tracking circuit 210 includes a buffer circuit 215 connected between soft-start/tracking pin 105 and voltage divider 117. Buffer circuit 215 is a high impedance unity gain amplifier that passes system voltage VSS (i.e., either the voltage generated by soft-start control circuit 112 or a predetermined master supply voltage). Buffer 215 is necessary because the softstart current is low, only 1 uA in one embodiment. By utilizing a low current, small capacitors 50 and 55 can be used, which in turn minimizes overall manufacturing costs associated with a system including voltage regulator 200. Because voltage divider 117 is utilized to implement both the softstart and tracking functions, voltage divider 117 would unduly load the 1 uA current source in softstart mode. Therefore, high impedance, low input current buffer 215 is utilized to drive voltage divider 117.

Output driver 135 is shown in additional detail in the right side of FIG. 2. A current limit amplifier 232 includes a first (+) input terminal that is connected to input pin 101, and a second (−) input terminal that is coupled to input pin 101 by way of a resistor R. A current driver amplifier 234 has a first (+) input terminal connected to an output terminal of current limit amplifier 232, and a second (−) input terminal connected to an output terminal of error amplifier 132. A first transistor 236 has a first terminal (emitter) connected to the second input terminal of the current limit amplifier, a second terminal (collector) connected to output pin 102, and a control terminal (base) connected to an output terminal of the current driver circuit 234. A second transistor 238 includes a first terminal (collector) connected to output pin 102, a second terminal (emitter) connected to ground, and a control terminal (base) connected to the output terminal of current driver circuit 234. Transistor 238 is driven only in the case where output voltage VOUT exceeds the desired regulated output voltage level, thereby limiting VOUT to the desired regulated output voltage level. Output voltage VOUT may exceed nominal levels, for example, during the 'soft stop' ramp down during shutdown cycle. This arrangement is referred to in the art as an active discharge loop.

In accordance with another aspect of the present invention, voltage regulator 200 further comprises a timing circuit 240 that provides additional user control. In particular, when either the soft-start or tracking inputs cause regulated output voltage VOUT to reach its intended voltage, a POR (Power On Reset) flag is typically released, producing a POR signal on a POR external pin 208. The POR signal is often used by external circuitry to determine the state of the power output from voltage regulator 200. In particular, upon reaching the intended output voltage VOUT, a current supplied to delay capacitor (DlyCap) pin 207 is initiated. This current causes a second, user-supplied external capacitor 55 that is connected to delay capacitor pin 207 to begin to charge. The POR signal is not released until this voltage reaches a predetermined level. This guarantees external circuitry controlled by the POR signal that power has been on and stable for a predetermined amount of time before the POR signal is asserted. Subsequently, when the device is disabled (e.g., when an enable (EN) signal supplied to external pin 206 is de-asserted), shut down of the regulated output voltage VOUT is delayed while capacitor 55 discharges. When capacitor 55 begins discharging, the POR signal is de-asserted, and in addition asserts a soft-start disable signal SSDis that is transmitted to soft-start control circuit 112. In response to the soft-start disable signal SSDis, soft-start control circuit 112 reverses current flow to soft-start/tracking pin 105, which causes the user-supplied capacitor 50 to discharge, thereby generating a gradually decreasing soft-stop ramp signal that causes regulated output voltage to ramp down at a controlled rate. This shut down operation guarantees that once the shut down signal is received, power will be on and stable for a known period. Such an interval can be used by microprocessors and other digital devices to save important data to battery backup memory or other non-volatile storage before power is removed.

Although the present invention has been described with respect to certain specific embodiments, it will be clear to those skilled in the art that the inventive features of the present invention are applicable to other embodiments as well, all of which are intended to fall within the scope of the present invention.

The invention claimed is:

1. A voltage regulator comprising:

a first external pin;

a soft-start control circuit for generating a current signal on the first external pin;

a first voltage divider coupled to the first external pin such that, when a first voltage is generated on the first external pin, the first voltage divider generates a fractional voltage that is equal to the first voltage multiplied by a first divider ratio;

an output circuit for generating a regulated output voltage that is equal to or less than the first voltage, the output circuit including:

a second voltage divider for generating a feedback voltage that is equal to the regulated output voltage multiplied by a second divider ratio, and an error amplifier having a first input terminal coupled to the first voltage divider, and a second input terminal connected to receive the feedback signal, wherein the first voltage divider comprises a first resistor coupled in series between the first external pin and the first input terminal of the error amplifier.

2. The voltage regulator according to claim 1, wherein the first divider ratio is substantially equal to the second divider ratio.

3. The voltage regulator according to claim 1, wherein the first divider ratio is slightly greater than the second divider ratio.

4. A voltage regulator comprising:

a first external pin;

a soft-start control circuit for generating a current signal on the first external pin;

a first voltage divider coupled to the first external pin such that, when a first voltage is generated on the first external pin, the first voltage divider generates a fractional voltage that is equal to the first voltage multiplied by a first divider ratio;

an output circuit for generating a regulated output voltage that is equal to or less than the first voltage, the output circuit including:

a second voltage divider for generating a feedback voltage that is equal to the regulated output voltage multiplied by a second divider ratio, and an error amplifier having a first input terminal coupled to the first voltage divider, and a second input terminal connected to receive the feedback signal;

a bandgap reference circuit for generating a bandgap signal having a predetermined voltage level; and a comparator circuit having a first input terminal connected to the first voltage divider and a second input terminal connected to receive the bandgap signal, wherein the comparator circuit includes means for generating a reference signal that is equal to the fractional voltage when the fractional voltage is lower than the predetermined voltage level of the bandgap signal, and is equal to the bandgap signal when the predetermined voltage level is lower than the fractional voltage, and wherein the comparator circuit is connected to the output circuit such that the reference signal is transmitted to the first input terminal of the error amplifier.

5. The voltage regulator according to claim 1, further comprising an output driver circuit for generating the regulated output signal in response to an output signal generated by the error amplifier.

6. The voltage regulator according to claim 5, further comprising:

an external input pin for receiving an unregulated input voltage; and an external output pin for receiving the regulated output signal generated by the output driver circuit, wherein the output driver circuit comprises:

a current limit amplifier having first and second input terminals coupled to the input pin;

a resistor connected between the first and second terminals of the current limit amplifier;

a current driver amplifier having a first input terminal connected to an output terminal of the current limit amplifier, and a second input terminal connected to an output terminal of the error amplifier;

a first transistor having a first terminal connected to the second input terminal of the current limit amplifier, a second terminal connected to the output pin, and a control terminal connected to an output terminal of the current driver circuit; and a second transistor having a first terminal connected to the output pin, a second terminal connected to ground, and a control terminal connected to the output terminal of the current driver circuit.

7. A voltage regulator comprising:

a first external pin;

a soft-start control circuit for generating a current signal on the first external pin;

a first voltage divider coupled to the first external pin such that, when a first voltage is generated on the first external pin, the first voltage divider generates a fractional voltage that is equal to the first voltage multiplied by a first divider ratio;

a buffer circuit connected in series between the first external pin and the first voltage divider;

an output circuit for generating a regulated output voltage that is equal to or less than the first voltage, the output circuit including:

a second voltage divider for generating a feedback voltage that is equal to the regulated output voltage multiplied by a second divider ratio, and an error amplifier having a first input terminal coupled to the first voltage divider, and a second input terminal connected to receive the feedback signal.

8. The voltage regulator according to claim 1, further comprising a timer control circuit including means for disabling the soft-start control circuit a predetermined delay period after an applied enable signal is de-asserted.

9. A voltage regulator comprising:

a soft-start control circuit including means for generating a current signal on a first external pin;

a first voltage divider including a first resistor having a first terminal connected to the soft-start control circuit, and a second resistor having a first terminal connected to a second terminal of the first resistor and a second terminal connected to a voltage source;

a comparator circuit having a first input terminal connected to the second terminal of the first resistor, and a second input terminal connected to a bandgap reference circuit;

an output circuit for generating a regulated output voltage on a second external pin, the output circuit including:

a second voltage divider including a third resistor having a first terminal connected to the second external pin, and a fourth resistor having a first terminal connected to a second terminal of the third resistor and a second terminal connected to the voltage source, and an error amplifier having a first input terminal connected to an output terminal of the comparator circuit, and a second input terminal connected to the second terminal of the third resistor.

* * * * *